US007232968B2

(12) United States Patent
Dykeman

(10) Patent No.: US 7,232,968 B2
(45) Date of Patent: Jun. 19, 2007

(54) ILLUMINATED IN-LINE CONTROLLER

(76) Inventor: Allan H. Dykeman, Apt 1206, 1300 Bloor Street East, Mississauga, Ontario (CA) L4Y 3Z2

( * ) Notice: Subject to any disclaimer, the term of this patent is extended or adjusted under 35 U.S.C. 154(b) by 0 days.

(21) Appl. No.: 10/925,920

(22) Filed: Aug. 26, 2004

(65) Prior Publication Data

US 2005/0045462 A1 Mar. 3, 2005

(30) Foreign Application Priority Data

Aug. 28, 2003 (CA) ..... 2438966

(51) Int. Cl.
*H01H 9/00* (2006.01)

(52) U.S. Cl. ..... 200/310; 200/314

(58) Field of Classification Search ..... 200/310–315, 200/339, 51 R, 51.03–51.06, 51.11, 51.12, 200/293

See application file for complete search history.

(56) References Cited

U.S. PATENT DOCUMENTS

| | | | | |
|---|---|---|---|---|
| 3,161,737 | A * | 12/1964 | Hall | 200/61.52 |
| 4,013,929 | A * | 3/1977 | Dietz et al. | 361/643 |
| 4,109,231 | A * | 8/1978 | Krouse | 338/200 |
| 4,485,282 | A * | 11/1984 | Lee | 200/51 R |
| 4,616,285 | A * | 10/1986 | Sackett | 361/1 |
| 4,755,691 | A * | 7/1988 | Bethea | 307/114 |
| 4,851,951 | A * | 7/1989 | Foster, Jr. | 361/50 |
| 4,875,871 | A * | 10/1989 | Booty et al. | 439/209 |
| 4,930,047 | A * | 5/1990 | Peterson | 361/736 |
| 5,097,383 | A * | 3/1992 | Heard et al. | 361/662 |
| 5,116,232 | A * | 5/1992 | Follett | 439/107 |
| 5,488,208 | A * | 1/1996 | Seewald | 200/43.22 |
| 5,570,114 | A * | 10/1996 | Fowler | 345/173 |
| 5,574,319 | A * | 11/1996 | Bennett | 307/114 |
| 5,731,763 | A * | 3/1998 | Herweck et al. | 340/825.69 |
| 5,755,319 | A * | 5/1998 | Szymanski et al. | 200/43.02 |
| 6,002,779 | A * | 12/1999 | Johnston | 381/80 |
| 6,104,586 | A * | 8/2000 | Robinson | 361/102 |
| 6,299,338 | B1 * | 10/2001 | Levinson et al. | 362/559 |
| 6,300,581 | B1 * | 10/2001 | Dweck et al. | 200/61.47 |
| 6,389,712 | B1 * | 5/2002 | Schelling | 36/15 |
| 6,402,002 | B1 * | 6/2002 | Benton | 224/600 |
| 6,504,117 | B2 * | 1/2003 | Overstreet | 200/86.5 |
| 6,700,062 | B1 * | 3/2004 | Allen, Jr. | 174/53 |
| 6,750,410 | B2 * | 6/2004 | Lee | 200/51.03 |
| 2002/0195324 | A1 * | 12/2002 | Lee | 200/51.03 |
| 2004/0206609 | A1 * | 10/2004 | Tilley | 200/10 |

FOREIGN PATENT DOCUMENTS

JP 02155136 * 6/1990

* cited by examiner

*Primary Examiner*—Michael Friedhofer
*Assistant Examiner*—Lisa Klaus

(57) ABSTRACT

This portable device relates to an in-line illuminated switch. The switch has a soft glowing light which is visible in a darkened room. Elderly people remove their eyeglasses when resting, and the soft glowing light locates the switch when light is required at bedside.

6 Claims, 2 Drawing Sheets

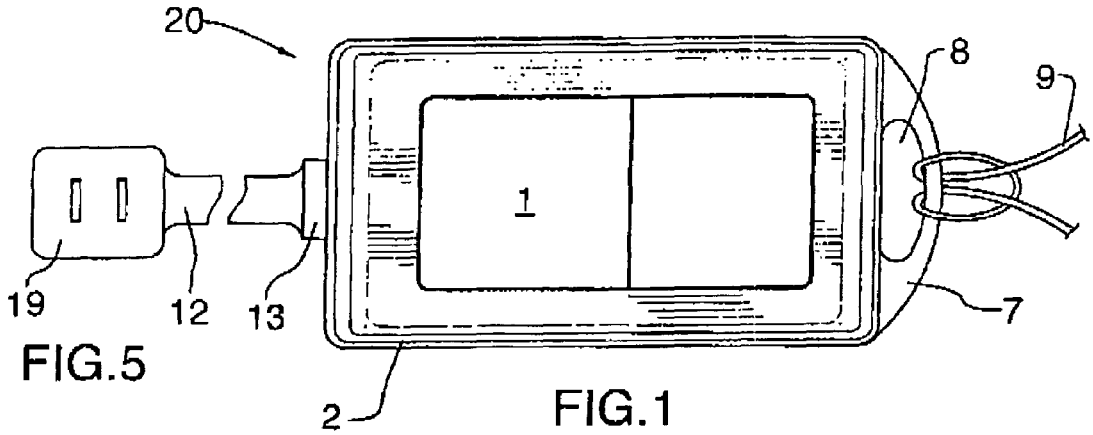
FIG.5
FIG.1
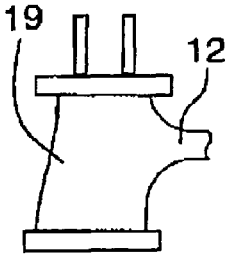
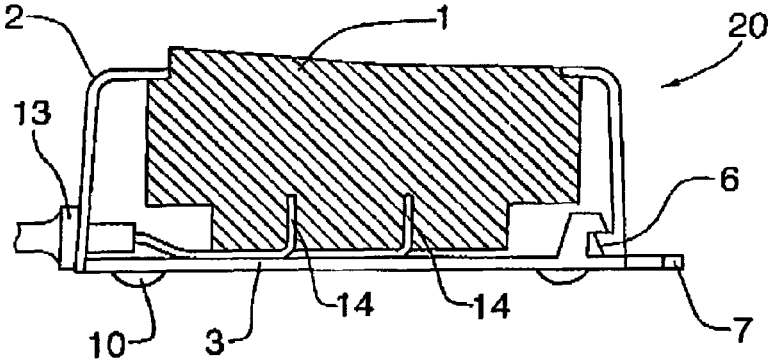
FIG.6
FIG.2
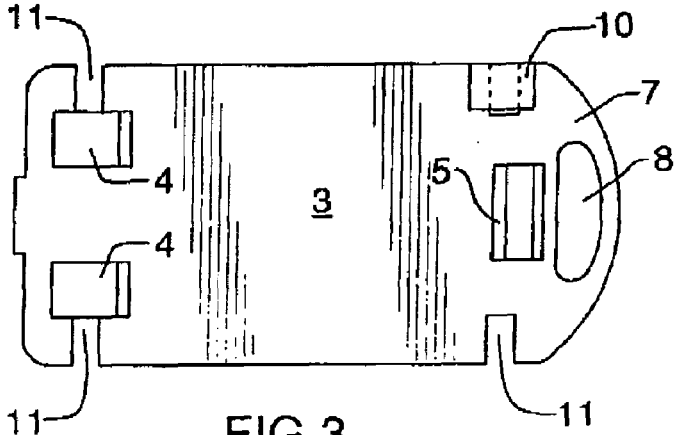
FIG.3
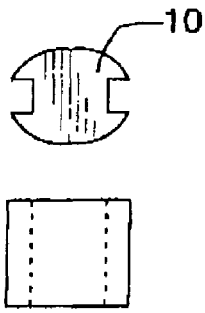
FIG.7
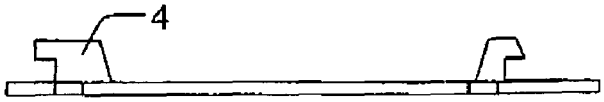
FIG.4

ILLUMINATED IN-LINE CONTROLLER

FIELD OF THE INVENTION

This portable device relates to an in-line switch, more specifically, to a switch with a soft glowing light.

BACKGROUND OF THE INVENTION

This invention relates to a novel configuration for a controller which can be used by elderly persons, disabled persons and hospital patients. People usually remove their eyeglasses when in bed and this makes it difficult to find a conventional switch in a darkened room when attempting to locate an electrical device such as a lamp near a bed. Use of this controller overcomes that difficulty. The device uses an illuminated rocker switch, of proven reliability, enclosed in a shock resistant plastic case. The device is connected to a power cord which terminates in a special split plug.

There are illuminated wall switches available, some with LED lights which cannot be used by persons in bed. There is a portable device made by Lutron Electronics under U.S. Pat. No. 4,104,606 that has a small LED light which is difficult for an elderly person to see in a dark room. The present device has a projection on the case which forms an aperture though which a string may be inserted to suspend the device for use in a sick bed or to childproof a room when appliances such as fans or electric heaters are being used.

SUMMARY OF THE INVENTION

A primary objective of the present invention is to provide a simple, reliable, portable in-line controlling device with a soft-glowing light to be used in a darkened room by elderly or disabled persons who remove their eyeglasses in bed. A further objective of the invention is to provide a device that is easily installed. The device has a minimum of parts which can be manufactured with conventional machinery and is easily assembled.

Toward these objectives a preferred embodiment is described as follows: A portable in-line illuminated switch enclosed in a shock resistant plastic case having skid resistant plastic feet. The switch is secured between the case and the base plate on assembly. A two conductor power cord, with tinned ends, is inserted in the switch. When the switch is assembled with the case and the base power cord exits the case and terminates in a M/F plug of a well-known type. The male part of the plug is inserted in a power source outlet and a bed lamp or such is inserted in the female part of said plug. A bed lamp may be controlled for bedside use. A further embodiment may be programmed to illuminate a hall or bathroom or such providing a safer environment.

According to a further preferred embodiment, a portable in-line switching device is provided that comprises: a housing and base of shock resistant material; an illuminated main switch constructed at least in part of a translucent shock-resistant material and received in a surface of the housing; an illuminating element contained in the switch for providing a source of light emission through the main switch; and a projection being part of the base defining an aperture for attaching the switching device; wherein the main switch is connected to a power cord terminating in a dual purpose plug and the main switch is operable between an open and a closed switch position by applying an operative force against at least a portion of the translucent shock-resistant material.

In one variation, the main switch is a rocker switch. In a further variation, the housing is fastened to a base. The main switch may also be a foot-operated switch.

The main switch may be a push button switch. The base mentioned above may comprise feet for reducing skidding on external surfaces. The feet may be inserted into a plurality of recesses defined in said base. The illuminating element is in electrical communication with the power cord.

In a variation, the base may comprise a raised area for guiding a power cord from the main switch out of the housing. The base may comprise a further first raised serration and the raised area guides the power cord from the main switch over the raised serration out of the housing. The housing may define a second raised serration opposing the first raised serration for securing the power cord when the housing is fastened to the base. The plane defined by the first and the second raised serration is preferably transverse to the axis of the power cord. Each of the raised serrations may press on a resilient insulation layer covering the power cord when securing the power cord.

The illuminating element may serve as a beacon for a person in a darkened environment or for use in a bed or in a room where an electric fan or an electric heater is being used.

The device may further comprise a second switch constructed at least in part of a translucent material and received in the surface of the housing. The translucent material of the second switch has a different colour from the translucent material of the main switch for distinguishing the second switch from the main switch.

In a further embodiment, this invention also includes a portable in-line switching device comprising: a housing constructed of shock-resistant plastic; a main switch constructed at least in part of a translucent material and received in a surface of the housing; and an illuminating element contained in the housing for providing a source of light for emitting light through the main switch; wherein the main switch is a rocker switch; the housing is fastened to a base, the base comprising two pedestals; the base comprises a projection defining an aperture for attaching the housing to an external object; and feet for reducing skidding on external surfaces.

BRIEF DESCRIPTION OF THE DRAWINGS

A preferred embodiment of the invention is described in the attached drawings in which:

FIG. 1 is a plan view of the preferred embodiment.

FIG. 2 is a side view of FIG. 1.

FIG. 3 is a plan view of the base plate.

FIG. 4 is a side view of FIG. 3.

FIG. 5 is a plan view of the M/F power cord adaptor.

FIG. 6 is a side view of FIG. 5.

FIG. 7 is an enlarged view of a soft plastic foot.

DETAILED DESCRIPTION OF THE INVENTION

Figure 8:
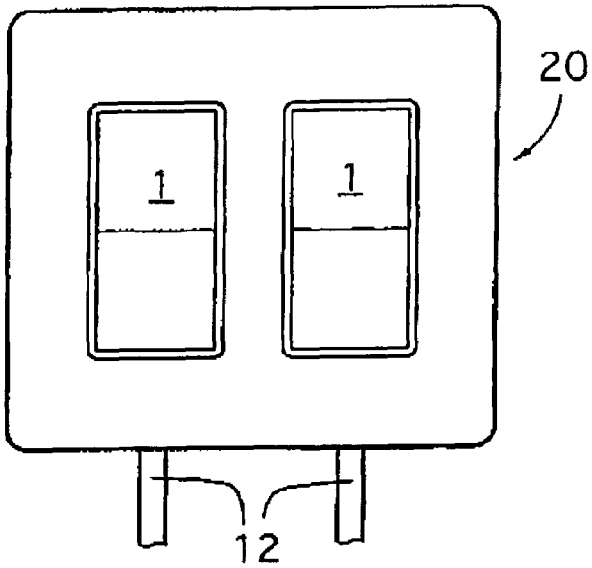
FIG. 8 is a plan view of gang configuration.

The preferred embodiment of the invention as a switching device or controller 20 is described as follows: FIG. 1 designates a portable illuminated rocker switch 1, secured with an impact-resistive case 2. The bottom plate 3, shown in FIG. 3 is preferably molded of similar material as the case 2. The bottom plate 3, shows projections 4, which are molded integrally with the bottom plate 3. Projection 5, is molded integrally with the bottom plate 3, and is used with projection 6, on the case on assembly to make a snap-in connection. The switch 1 is secured between the case 2 and the bottom plate 3 on assembly. A two conductor power cord 12, with tinned ends 14, is inserted in the switch. The base plate 3, is extended beyond the length of the case at 7 to form an aperture 8, through which a string 9, may be inserted to attach the housing to an external object (such as for hanging the device above a bed , or out of a child's reach). The soft plastic feet 10, shown in FIG. 7 may be inserted in slots 11, on assembly. FIGS. 5 and 6 show a M/F plug 19 which is moulded with a two-conductor cord 12, and strain relief fitting 13, to form a harness. The two-conductor cord 12 ends are inserted in the switch 1 on assembly. The cord 12 is typically covered by an insulating layer.

Further embodiments of the invention are described in the drawings FIGS. 8, 9, 10, 11.

Figure 9:
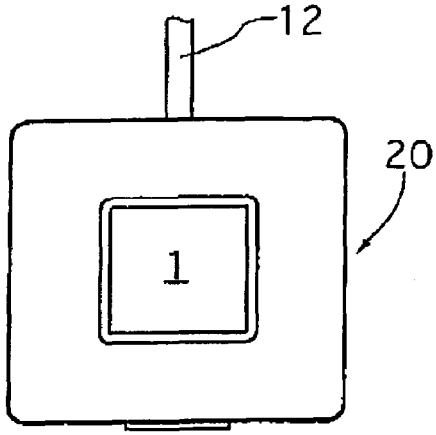
FIG. 9 is a plan view of a bed lamp controller with illuminated push-button face.
Figure 10:
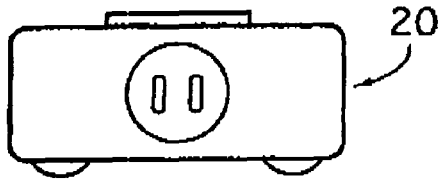
FIG. 10 is a side view of FIG. 9.
Figure 11:
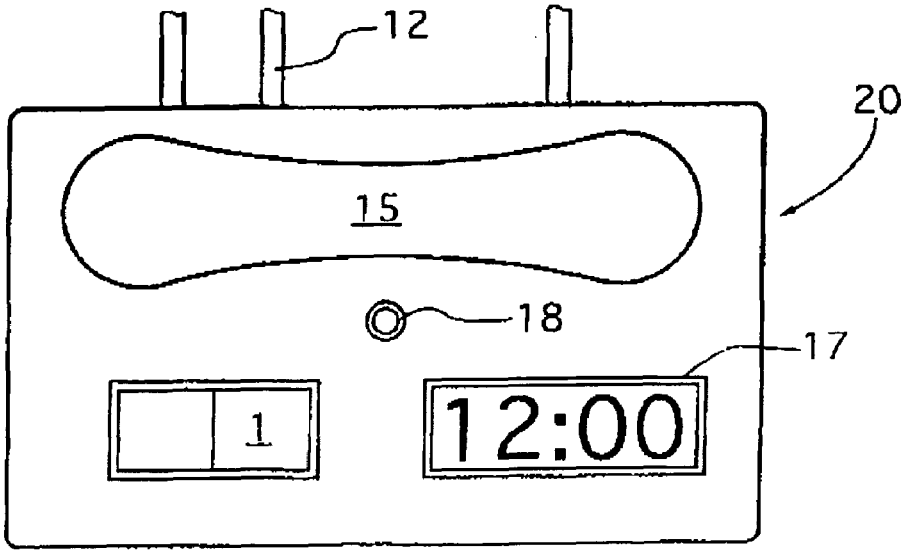
FIG. 11 is a plan view of a console configuration.

FIG. 8 represents a gang configuration of the controller 20 with different colour soft glowing lights for different tasks. FIG. 9 represents a switch 1 with a soft glowing light and pushbutton configuration. FIG. 10 is a side view of FIG. 9 and a female receptacle is shown as a power source for an additional appliance. FIG. 11 represents a console configuration with a telephone 15, a switch 1 with a soft-glowing light, a clock 17 and an outlet 18 for a computer. The illuminated controller 20 may be for use with a Christmas tree and patio lighting and an illuminated workshop controller. A foot-operated switch is also a possible variation.

Although preferred embodiments have been described, many variations and modifications will be apparent to those skilled in the art. Such variations include one with a magnet (permanent or not) attached to a bed lamp controller for use in hospitals where much of the furniture is enamelled metal. All of these devices may be produced in decorator colours. Such variations and modifications are not to be regarded as a departure from the spirit and scope of the present invention, and all such as would be apparent to those skilled in the art are intended to be included within the scope of the following claims.

What is claimed is:

1. A portable in-line switching device, easily operable by physically and visually impaired persons, comprising:

a housing and base of shock resistant material, the housing fastened to the base;

the base comprising feet for reducing skidding on external surfaces, the feet inserted into a plurality of recesses defined in said base;

an illuminated main switch constructed at least in part of a translucent shock-resistant material and received in a surface of the housing, the main switch selected from the group consisting of a rocker switch and a push-button switch; and a projection being part of the base defining an aperture for attaching the switching device to an external object;

wherein the main switch is connected to a power cord terminating in a dual purpose plug and the main switch is operable between an open and a closed switch position by applying an operative force against at least a portion of the translucent shock-resistant material.

2. The device according to claim 1, wherein the illuminating element is in electrical communication with the power cord.

3. The device according to claim 1, further comprising:

a second switch constructed at least in part of a translucent material and received in the surface of the housing.

4. The device according to claim 3, wherein the translucent material of the second switch has a different color from the translucent material of the main switch for distinguishing the second switch from the main switch.

5. The device according to claim 1, wherein the illuminating element serves as a beacon for a person in a darkened environment.

6. The device according to claim 1 for use in a bed or in a room where an electric fan or an electric heater is being used.

* * * * *